United States Patent [19]

Mobley et al.

[11] Patent Number: 5,009,615

[45] Date of Patent: Apr. 23, 1991

[54] TERMINAL ASSEMBLY WITH FIXED AND FLEXIBLE TAB RECEPTACLE RETAINERS

[75] Inventors: Dewey F. Mobley, Lake Orion; Robert G. Peterson, Sr., Canton; James E. LaCava, Novi, all of Mich.

[73] Assignee: Interlock Corporation, Westland, Mich.

[21] Appl. No.: 544,414

[22] Filed: Jun. 27, 1990

Related U.S. Application Data

[63] Continuation of Ser. No. 248,591, Sep. 26, 1988, abandoned.

[51] Int. Cl.[5] ..... H01R 13/40; H01R 13/422

[52] U.S. Cl. ..... 439/595; 439/594

[58] Field of Search ..... 439/594–596

[56] References Cited

U.S. PATENT DOCUMENTS

| | | | |
|---|---|---|---|
| 4,557,542 | 12/1985 | Coller et al. | 439/595 |
| 4,571,017 | 2/1986 | Fujita | 439/595 |
| 4,664,460 | 5/1987 | Vandame | 439/595 |
| 4,714,437 | 12/1987 | Dyki | 439/595 |

*Primary Examiner*—Paula A. Bradley

*Attorney, Agent, or Firm*—Harness, Dickey & Pierce

[57] ABSTRACT

An electrical terminal assembly having fixed and flexible tab receptacle terminal retainers. Each inserted receptacle terminal is retained by means of a movable finger formed in one side wall of the receptacle connector cavity and a fixed retaining shoulder in the opposite internal side wall of the connector cavity, both shoulders engaging the inserted female receptacle terminal. The receptacle terminal is removed by resiliently deflecting the movable finger to disengage the retaining shoulder thereon from the receptacle terminal thereby allowing withdrawal of the receptacle terminal.

1 Claim, 2 Drawing Sheets

TERMINAL ASSEMBLY WITH FIXED AND FLEXIBLE TAB RECEPTACLE RETAINERS

This is a continuation of U.S. patent application Ser. No. 248,591, filed on Sept. 26, 1988 and, now abandoned.

BACKGROUND AND SUMMARY OF THE INVENTION

This invention relates generally to electrical connectors and more particularly to electrical receptacle terminal assemblies.

Various insulated receptacle terminal assemblies or connectors have been devised for engaging a male terminal with a mating receptacle terminals. However, in the case of the tab receptacle terminal, once the is terminal is inserted into the connector body, internal projections within the connector body engage the tab receptacle terminal such that either withdrawal of the terminal from the body or further insertion is prevented.

A present technology electrical tab receptacle terminal connector with visually inspectable components is disclosed in copending U.S. patent application Ser. No. 107,681, filed Oct. 13, 1987, owned by the assignee of this application and is incorporated herein by reference. The receptacle terminal connector described in application Ser. No. 107,681 allows the receptacle terminal to be extracted from the connector without the use of special tools thus allowing for visual inspection of the receptacle terminal and the internals of the connector.

In present technology tab receptacle terminal assemblies, a tab receptacle terminal is inserted within a terminal connector cavity and locked in place by an internal projection in the connector cavity. If an excessive pulling force is applied to the wire connected to the tab receptacle terminal, the projecting locking tab or retaining shoulder inside the connector may be sheared off. This will then allow the receptacle terminal to be "pushed out" of the connector block when insertion of a male tab terminal is attempted. This shearing of the locking projection and resultant pushout of the terminal from the connector body is the major problem in terminal connectors of this type, hence the visually inspectable feature.

It is therefore an object of the invention to provide an improved engagement of an inserted tab receptacle terminal within a tab receptacle terminal connector cavity.

It is a further object of the invention to provide a tab receptacle terminal connector wherein the tab receptacle terminals are easily removed.

It is a still further object of the invention to provide a tab receptacle terminal connector having visually inspectable components.

The present invention eliminates the pushout problem of present tab receptacle connectors by providing a locking projection or retainer in the interior walls of the connector on each side of the inserted tab receptacle terminal. One of these projections is fixed, the other is part of a biased finger as in application Ser. No. 107,681. This biased finger is biased toward the inserted tab receptacle terminal thus ensuring firm engagement of the tab receptacle terminal with both locking projections because the locking projections project into apertures in the opposite faces of the inserted tab receptacle terminal.

An example of a suitable tab receptacle terminal which may be used in the present invention is more fully described in copending U.S. application Ser. No. 916,950 filed Oct. 8, 1986, owned by the assignee of this application and incorporated herein by reference.

A tab receptacle terminal fully inserted into the connector according to the present invention is firmly held in place. Insertion of the blade of a male tab terminal within the receptacle will cause a certain amount of force to be exerted against the locking projections. However, in the present invention, this force is transmitted to both projections thus permitting twice the total force to be applied without danger of shearing off the projections. This total force capability prior to shearing of the locking projections is much greater than the force required for blade insertion. In addition, normal anticipated tugging on connected wires will not cause shearing. Therefore the pushout problem is eliminated by the additional locking projections.

DETAILED DESCRIPTION OF THE INVENTION

Figure 2:
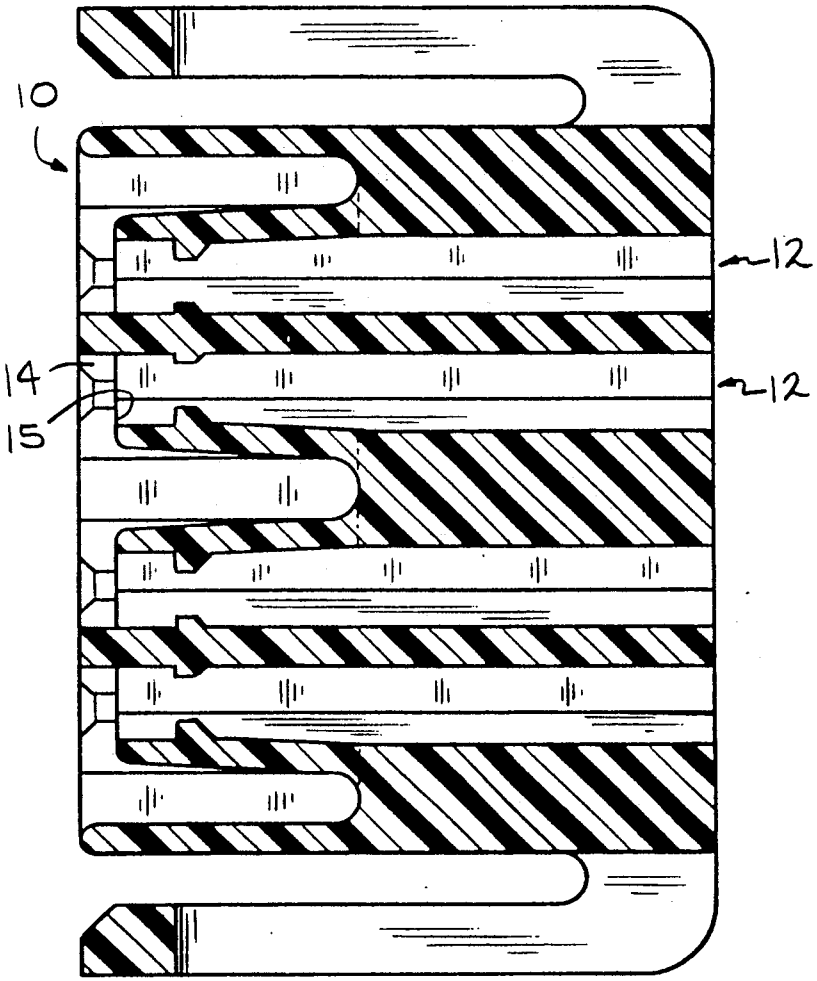
FIG. 2 is a sectional view of the terminal assembly body shown in FIG. 1 taken along lines 2—2.
Figure 1:
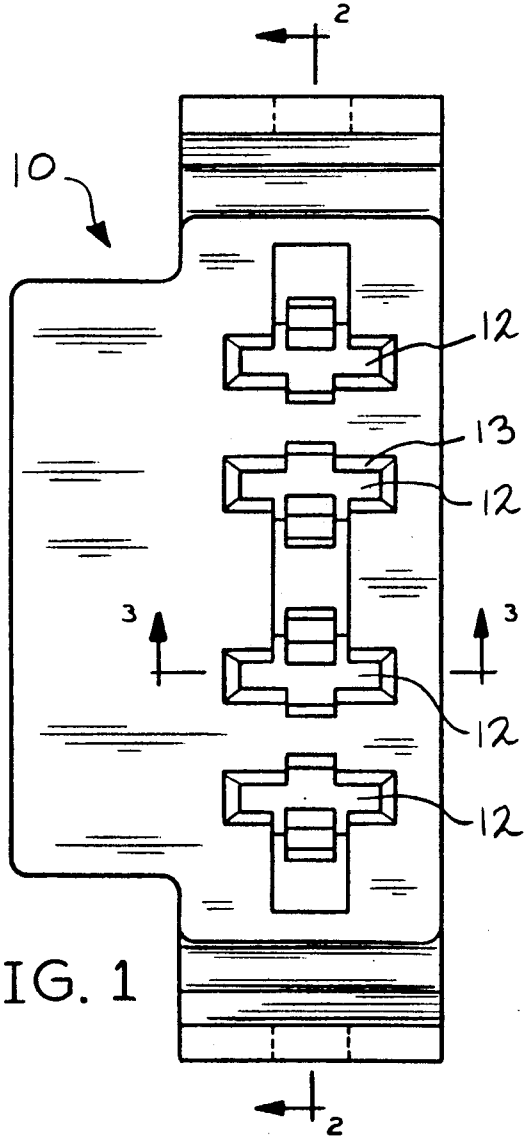
FIG. 1 is a front end view of the assembly body in which tab receptacle terminals in the terminal assembly of this invention are mounted.

With reference to the drawing, the terminal assembly of this invention is shown in FIGS. 1 and 2 as comprising a hollow body 10 formed of a molded plastic material and configured with a plurality of cavities 12, illustrated as four in number, for a like number of tab receptacle terminals 16.

Each tab receptacle terminal cavity 12 has inwardly directed stop shoulders 14 at the forwardly terminating end of cavity 12. The shoulders 14 prevent insertion of a tab receptacle terminal 16 further than the full insertion depth shown in FIG. 6.

The inner surface 15 of each shoulder 14 projects inward at right angles to the axis of terminal insertion. The outer surface 13 of each shoulder 14 is sloped inward to guide the insertion of a male terminal into the corresponding cavity 12.

Figure 3:
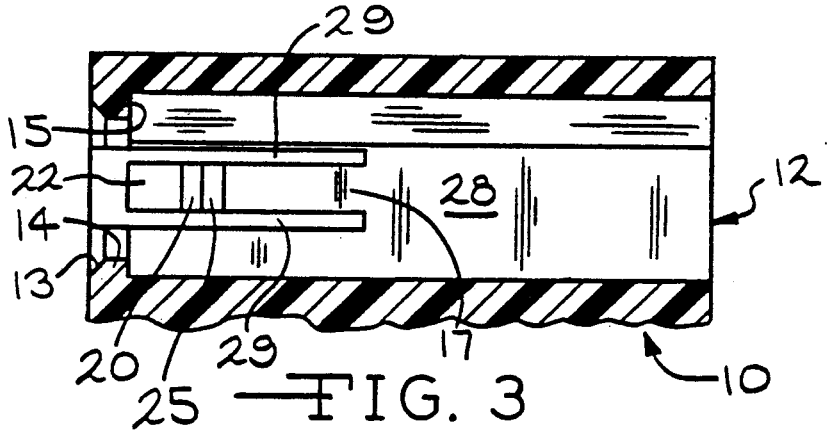
FIG. 3 is a fragmentary sectional view of the terminal assembly body shown in FIG. 1 taken on the lines 3—3.

Inside each cavity 12 and spaced from shoulders 14, are inwardly projecting retaining tabs or shoulders 18 and 20 which are integrally formed on interior cavity walls 26 and 28 respectively. Each wall 28 includes a movable portion consisting of a finger member 22 which is integrally formed at only one end 17 with the body 10 so that it can deflect within the cavity 12 in directions toward and away from opposite shoulder 18. As shown in FIG. 3, finger 22 is cantilever supported from the sidewall 28 of cavity 12 and is separated therefrom at its sides by two parallel slits 29.

Figure 4:
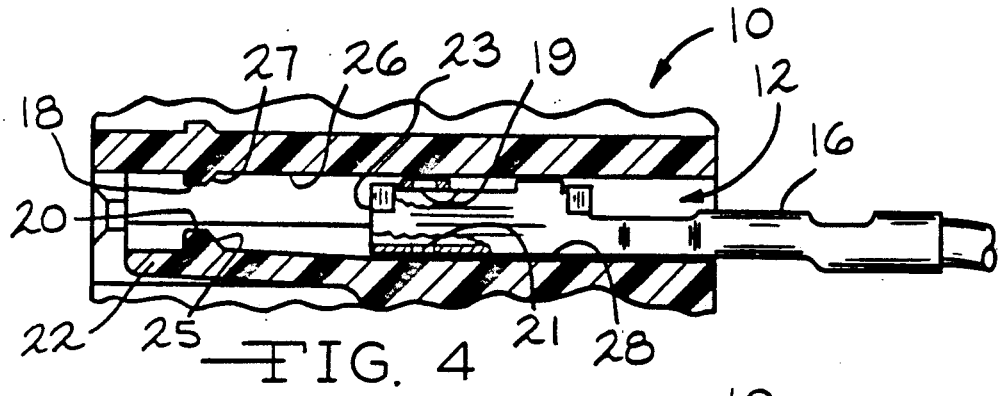
FIG. 4 is a fragmentary sectional view of one of the tab terminal receptacle cavities shown in FIG. 2 showing a tab receptacle terminal partially inserted therein.
Figure 5:
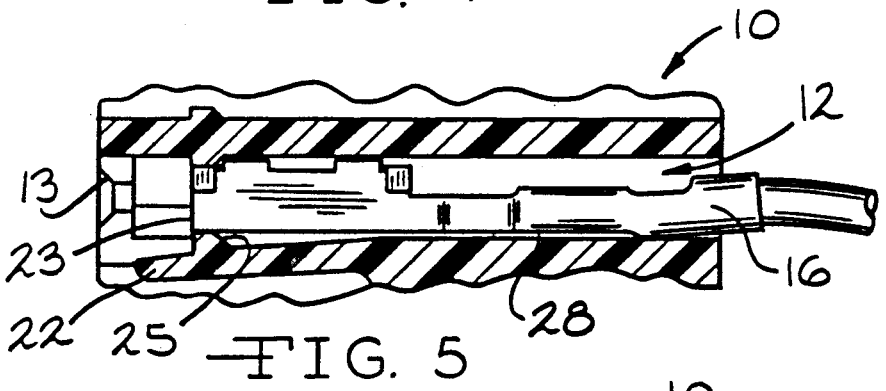
FIG. 5 is a fragmentary sectional view like FIG. 4 showing the tab receptacle terminal inserted further so as to push the movable locking projection outward.
Figure 6:
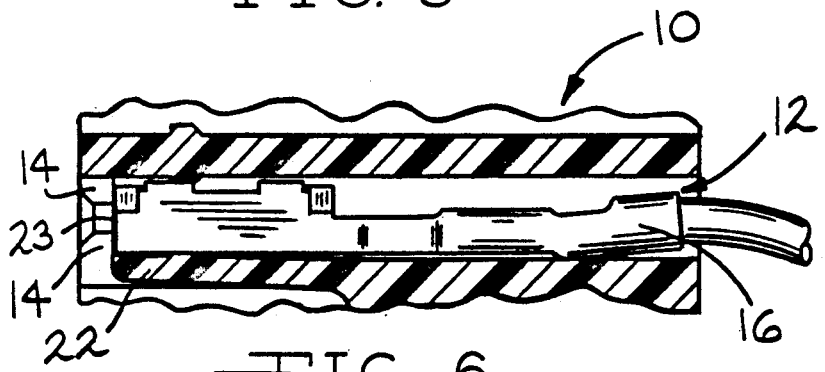
FIG. 6 is a sectional view like FIG. 4 showing the tab receptacle terminal fully inserted in the body cavity.

Each shoulder 18 is formed on a non-movable or stationary wall 26 within the body 10. The tab receptacle terminal 16 has two opposing apertures 19 and 21 into which the shoulders 18 and 20 project when receptacle terminal 16 is fully inserted within cavity 12 as shown in FIG. 6. As shown in FIG. 4, in a relaxed state, finger 22 is slightly biased inward toward the opposite wall 26 of cavity 12. As tab receptacle terminal 16 is inserted it is advanced toward the left as viewed in FIG. 4. When the forward end 23 of terminal 16 engages the inclined ramp surface 25 on the inner side of shoulder 20, the finger 22 is deflected in a direction away from wall 26, as shown in FIG. 5. The engagement of forward end 23 with the inclined surface 27 on the inner side of shoulder 18 causes a similar deflection of receptacle terminal 16. The forward portion of terminal 16 is deflected away from wall 26 until the shoulder 18 is aligned with aperture 19 in tab receptacle terminal 16.

In FIG. 6, tab receptacle terminal 16 is fully inserted with both shoulders 18 and 20 aligned with and projecting into the corresponding apertures 19 and 21 in terminal 16 and the forward end 23 of terminal 16 engaging shoulders 14. Terminal 16 is thus locked in place. Once tab receptacle terminal 16 is fully inserted within cavity 12 of body 10, an applied force tending to cause terminal 16 to be withdrawn will result in no motion so long as finger 22 is not deflected away from engagement with tab receptacle terminal 16. In addition, any applied withdrawal force is opposed by both projections 18 and 20 against the aperture walls in the upper and lower sides of tab receptacle terminal 16.

When the male terminals have been removed from the body 10, the tab receptacle terminals 16 can be individually removed. To remove a tab receptacle terminal 16, the retaining shoulder 20 is deflected out of engagement with the aperture 21 in the tab receptacle terminal 16 by manually deflecting the finger 22 from its terminal retaining position shown in FIG. 6 to its release position shown in FIG. 5, and terminal 16 is manipulated to dislodge it from the shoulders 18 and 20. Tab receptacle terminal 16 can then be withdrawn from body 10. This enables easy inspection of the body 10 and the tab receptacle terminals 16 housed within.

The present invention has been described in an illustrative manner. It is to be understood that the terminology which has been used is intended to be in the nature of words of description rather than of limitation. Obviously many modifications and variations of the present invention are possible in light of the above teachings. Accordingly, the teachings of the present invention, within the scope of the appended claims, may be practiced other than as specifically described.

What is claimed is:

1. An electrical terminal assembly comprising:

a stationary first wall member having a first shoulder extending therefrom;

a stop shoulder having first and second ends thereon and being connected to said first wall member at said first end;

a second wall member having a plurality of slots formed therein defining a flexible finger having a second shoulder protruding therefrom, said second wall member being connected to said stop shoulder at said second end thereof, said second wall member cooperating with said first wall member and said stop shoulder to define a terminal receiving cavity, said finger being biased in a direction inwardly of said cavity and cooperating with said cavity to allow a terminal to be received thereinto, said first shoulder of said stationary first wall and said second shoulder of said biased finger being positioned inward of said cavity and coacting with the terminal to secure the terminal therein, said stop shoulder preventing further insertion of the terminal, said finger being deflectable in a direction outwardly of said cavity permitting removable of the terminal from said assembly.

* * * * *